US007254860B2

(12) United States Patent
Dumler et al.

(10) Patent No.: US 7,254,860 B2
(45) Date of Patent: Aug. 14, 2007

(54) MASCARA BRUSH

(75) Inventors: Norbert Dumler, Ansbach (DE); Helmut Stredak, Aurach (DE)

(73) Assignee: Geka Brush GmbH, Bechhofen (DE)

( * ) Notice: Subject to any disclaimer, the term of this patent is extended or adjusted under 35 U.S.C. 154(b) by 291 days.

(21) Appl. No.: 10/244,023

(22) Filed: Sep. 16, 2002

(65) Prior Publication Data

US 2003/0172485 A1 Sep. 18, 2003

(30) Foreign Application Priority Data

Mar. 16, 2002 (DE) ..... 102 11 780

(51) Int. Cl.
*A46B 9/02* (2006.01)
*A46B 3/18* (2006.01)

(52) U.S. Cl. ..... 15/207.2; 15/DIG. 5

(58) Field of Classification Search ..... 15/206, 15/207.2, 160, DIG. 5, 159.1, 104.94, 207; 132/218, 317, 370, 216; 401/129
See application file for complete search history.

(56) References Cited

U.S. PATENT DOCUMENTS

| | | | | |
|---|---|---|---|---|
| 5,542,439 | A * | 8/1996 | Gueret | 132/218 |
| 5,761,760 | A * | 6/1998 | Dumler et al. | 15/206 |
| 5,862,812 | A * | 1/1999 | Dumler | 132/218 |
| 5,918,994 | A * | 7/1999 | Gueret | 401/122 |
| 6,260,558 | B1 | 7/2001 | Neuner | |
| 6,279,583 | B1 * | 8/2001 | Neuner | 132/218 |
| 6,289,902 | B1 | 9/2001 | Mathiez | |
| 6,341,913 | B1 * | 1/2002 | Wilson-Jackson | 401/129 |
| 6,394,678 | B2 * | 5/2002 | Schrepf | 401/126 |
| RE38,230 | E * | 8/2003 | Gueret | 132/218 |

FOREIGN PATENT DOCUMENTS

| | | | |
|---|---|---|---|
| DE | 37 35 963 | C2 | 4/1988 |
| DE | 69408117 | | 5/1998 |
| DE | 10003858 | | 8/2001 |
| EP | 0792603 | | 9/1997 |
| EP | 0 832 580 | A1 | 4/1998 |
| EP | 1 000 566 | A2 | 5/2000 |
| EP | 1000566 | * | 5/2000 |
| EP | 1 129 641 | A2 | 9/2001 |
| FR | 2800249 | | 5/2001 |
| FR | 2811525 | A1 * | 1/2002 |
| JP | 02161909 | A * | 6/1990 |
| WO | WO 02/07562 | * | 1/2002 |

* cited by examiner

*Primary Examiner*—Terrence R. Till
(74) *Attorney, Agent, or Firm*—Browdy and Neimark, PLLC

(57) ABSTRACT

In a mascara brush comprising a plurality of bristles held between two twisted wire segments, wherein the bristles have varying lengths created by trimming, provision is made for the brush to incorporate a first outer face of a predefined geometry created in a first trimming process after twisting, wherein this outer face is formed by the tips of a first number of longer bristles, wherein a portion of the bristles is trimmed by a second trimming process, so that a plurality of bristles of a shorter length is created, the tips of which form a second envelope of a predefined geometry, wherein the tips of the shorter bristles each lie on an orthogonal line relative to these twisted wire segments extending at a distance to the same.

7 Claims, 4 Drawing Sheets

MASCARA BRUSH

BACKGROUND OF THE INVENTION

1. Field of the Invention

The present invention is directed to a mascara brush comprising a plurality of bristles held between two twisted wire segments, wherein the bristles have varying lengths created by trimming.

2. Background Art

Mascara brushes of this type must have good transfer properties, on one hand, to transfer the mascara fluid from a reservoir container onto the user's eyelashes, and advantageous application properties must exist on the other hand, to evenly distribute the transferred mascara fluid on the eyelashes, and lastly, the application process must go hand in hand with a separation of the lashes to prevent them from sticking together;

To achieve these goals, numerous solutions are known, wherein a targeted selection of the bristle material, bristle thickness and bristle length prior to the twisting of the wire segments is described on one hand, and various techniques for trimming the twisted brush on the other hand.

From U.S. Pat. No. 6,289,902 it is known to use as the wire a plastically deformable wire and completely cut off the bristles in predefined angular sectors or shorten them to a uniform radial length.

From U.S. Pat. No. 6,279,583, a production technique is known, wherein the bristles are initially fixed temporarily between the wire segments by means of a partial twisting, after which they are trimmed and ultimately fixed permanently by further twisting. This is an expensive production technique and does not permit a high production speed.

U.S. Pat. No. 6,260,558 B1 describes a manufacturing process for a mascara brush whereby a brush is created that has bristles of different lengths in different sectors. This method of production is also extraordinarily expensive and not suitable for an economic mass production.

WO 96/311 describes a mascara brush that incorporates, relative to its longitudinal axis, sectors with bristles in varying densities, which is attained in such a way that the compartment box from which the bristles are taken during the twisting is stocked with bristles in varying densities.

From DE 37 35 963 D2 it is known to trim the finished brush in such a way that comb zones are attained to improve the combing effect.

From EP 1 129 641 A2 it is known to process bristles of different materials with varying densities, viewed in the longitudinal direction of the brush.

EP 0 832 580 A1 describes a mascara brush, wherein in a first trimming process, a crowned, cigar-like basic shape is created and then, in a second trimming process, cutouts that extend in the longitudinal direction.

From EP 1 000 566 A2, a mascara brush is known, the outer face of which is essentially trimmed square in cross section.

SUMMARY OF THE INVENTION

With these known solutions as the starting point, the present invention has as its object to create a mascara brush that is optimally adaptable to the basic requirements for a brush of this type, as well as to the subjective desires of the consumer.

This object is met according to the invention in such a way that the brush incorporates a first outer face of a predefined geometry that is created in a first trimming process after the twisting, wherein this outer face is formed by the tips of a first number of longer bristles, wherein a portion of these bristles is trimmed by a second trimming process, so that a plurality of bristles of a shorter length is created, the tips of which form a second envelope of a predefined geometry, wherein the tips of the shorter bristles each lie on an orthogonal line relative to the twisted wire segments extending at a distance to the same.

Provision is preferably made for the tips of the shorter bristles to also lie on a line parallel to the twisted wire segments.

According to the invention, a brush that has been produced according to a conventional production method thus is not trimmed in the second trimming process in such a way that the bristles are completely cut off or shortened in certain zones, be it viewed in the circumferential direction or in the longitudinal direction, but instead only a thinning cut is performed in such a way that only a portion of the bristles is shortened in each case, and the longer bristles, due to their spreading away from the wire core, form a largely even outer envelope with their tips.

By creating, according to the invention, zones with a reduced number of fiber tips without reducing the total number of fibers in the brush per winding, it is possible, in adaptation to the given type of consumer, to attain an increased mass depot there in a targeted fashion.

Hence, according to the invention, no rotating cutting tools are used to perform the second cut, and the brush is not cut in a rotating fashion, since otherwise all fibers would be shortened evenly in the trimmed sections, as it is known from the prior art.

The envelope of the shorter bristles may advantageously be designed in such a manner that trimmed and untrimmed zones alternate in relatively short order, i.e., the envelope has a comb-like structure. The width of the zones that are trimmed in the second cut is advantageously between 0.6 and 2.8 mm, specifically 1.2 mm, and the width of the untrimmed zones is between 0.4 and 3 mm, specifically 0.8 mm.

The envelope of the shorter bristles may extend either only along a central region of the brush or alternately along both end regions. It is furthermore possible for the second cut to be applied only to one side of the brush.

The inner envelope may be rectangular or triangular in cross section or rounded off, and the center longitudinal axis of the envelope may coincide with the twisted wire segments or be offset from the same.

The outer envelope may have any known geometry, i.e., especially cylindrical, conical, crowned, concave or a combination of these basic shapes.

The invention will be explained in more detail below based on preferred embodiments in conjunction with the drawing.

DESCRIPTION OF THE PREFERRED EMBODIMENTS

Figure 1:
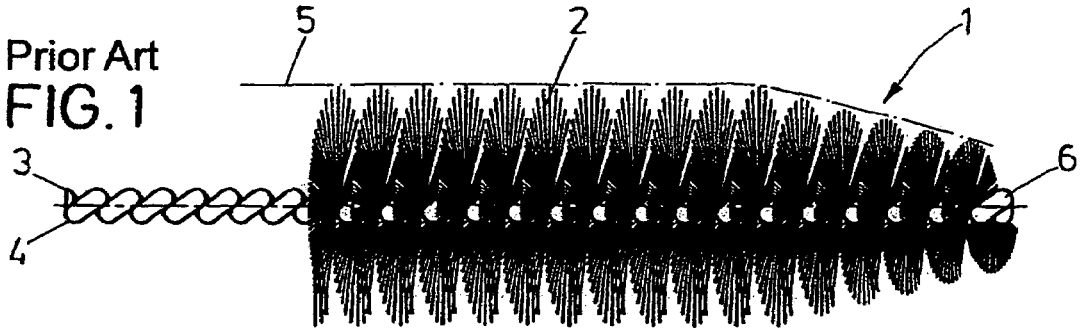
Prior Art FIG. 1
FIG. 1 shows a side view of a conventional mascara brush wherein the tips of the bristles have been trimmed.

Presented in FIG. 1 is a conventional mascara brush 1, wherein a plurality of bristles 2 is fixed between two twisted wire segments 3, 4. By means of a first cut, the bristles 2 have been trimmed such that their tips form a cylindrical envelope 5 that conically narrows toward its outer end 6.

With such a basically known brush as the starting point, a second cut takes place according to the invention in such a way that the tips of the bristles that have been shortened by such a second cut lie on a second, inner envelope 7, with the tips 8 of the shorter bristles 9 lying on an orthogonal line extending at a distance A to the center longitudinal axis of the brush.

Figure 2:
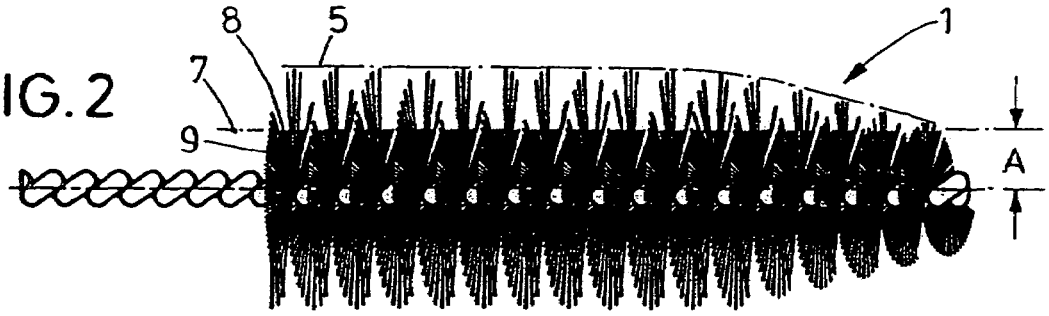
FIGS. 2 through 4 show side views of inventive mascara brushes with different second trims.
Figure 3:
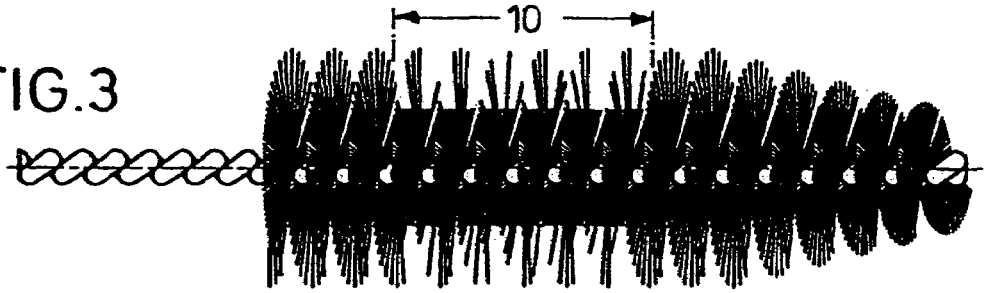
Figure 4:
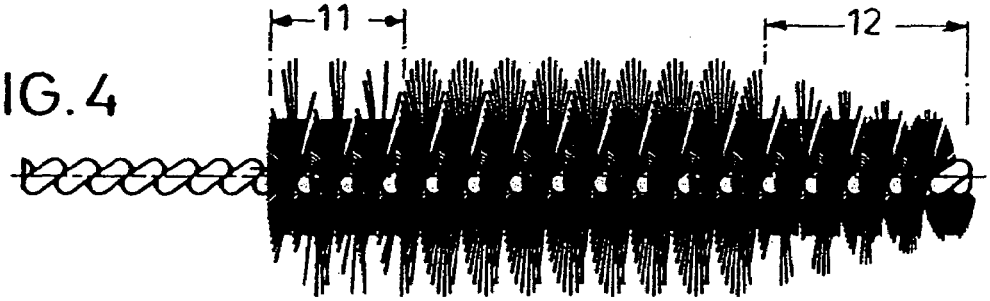

In the embodiment according to FIG. 2, the second cut extends along the entire length of the brush 1, in the embodiment according to FIG. 3 it extends along a central section 10, and in the embodiment according to FIG. 4 it extends along outer sections 11 and 12.

Figure 7:
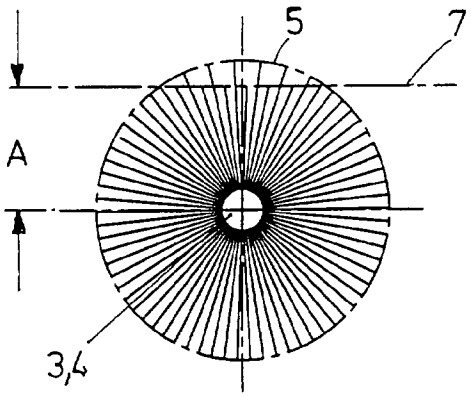
FIGS. 5 through 7 show schematic cuts in planes perpendicular to the twisted wires.
Figure 6:
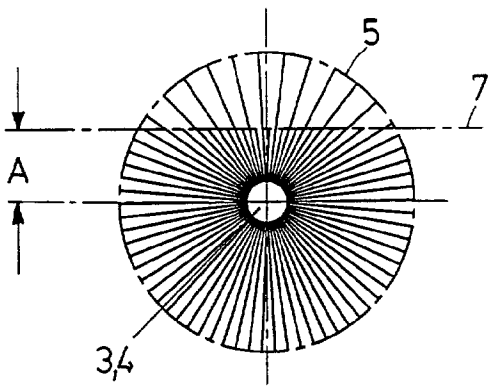
Figure 5:
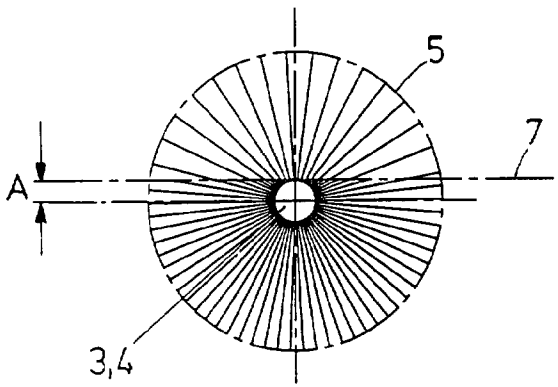

In the embodiments according to FIG. 5 through 7, only a single trimming plane is used for the second cut, which, accordingly, forms the second, inner envelope 7 and has a varying distance A to the core of the brush formed by the twisted wires 3, 4.

In the embodiments according to FIG. 8 through 13, a plurality of trimming planes is used in each case for the second cut to thin out the bristle thickness.

Figure 8:
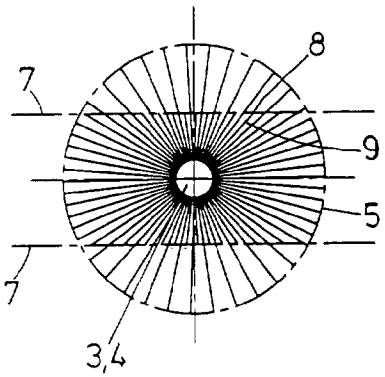

In the embodiment according to FIG. 8, the trimming plane and, hence, the envelopes 5 extend parallel to one another and at the same distance to the twisted wires 3, 4.

Figure 9:
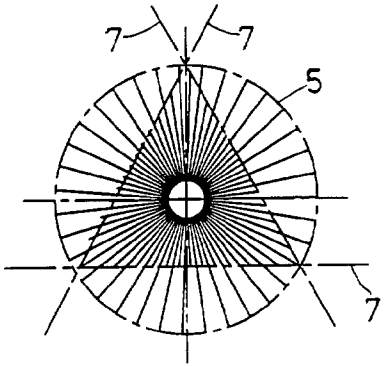

In the embodiment according to FIG. 9, the first brush is rotated by 120° after creation of the first trimming plane, again trimmed along a flat surface and again rotated by 120° and trimmed along a flat surface.

Figure 10:
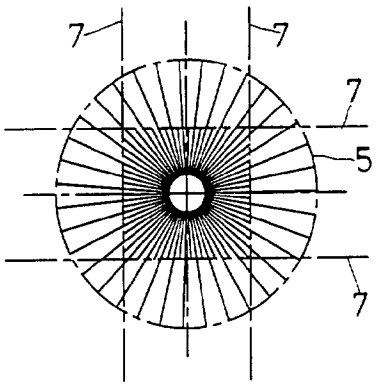
FIGS. 8 through 13 show embodiments with multiple trimming planes of the second cut.

In the embodiment according to FIG. 10, the brush is rotated by 90° after each cut, so that a square cross section is attained for the inner envelope.

The embodiment according to FIG. 4 is a modification of the embodiment according to FIG. 10, wherein the longer bristles are not trimmed cylindrical, as in FIG. 8 through 10, but square in cross section.

Figure 11:
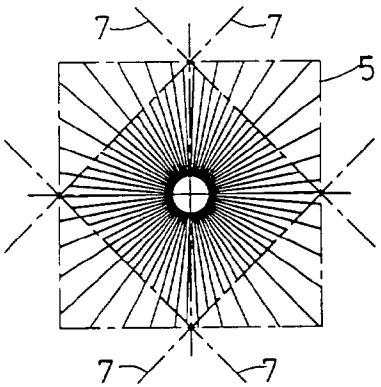

In the embodiment according to FIG. 11, the outer envelope 5 is square in cross section and the inner envelope 7 is also trimmed square, with the tips of the two squares pointing in the same direction.

Figure 12:
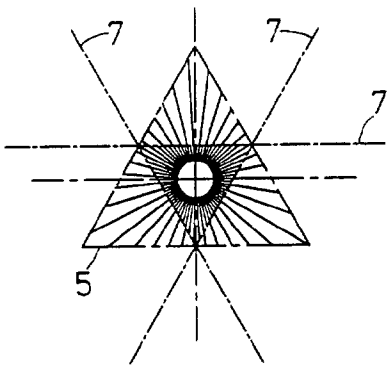

In the embodiment according to FIG. 12, the outer envelope 5 is triangular in cross section and the inner envelope 7 is also trimmed triangular, with the tips of the two triangles pointing in opposite directions.

Figure 13:
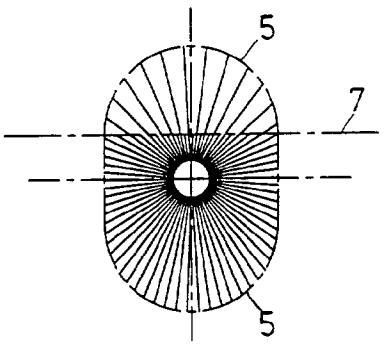

In the version according to FIG. 13, two side surfaces are provided that are parallel to one another and connected via rounded regions.

Figure 14:
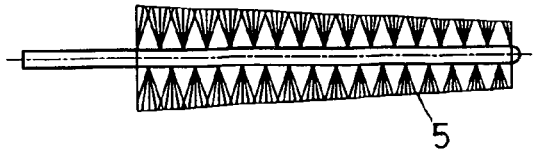
FIGS. 14 through 22 show various geometries of the first, outer envelope of the longer bristles.
Figure 15:
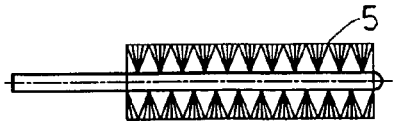
Figure 16:
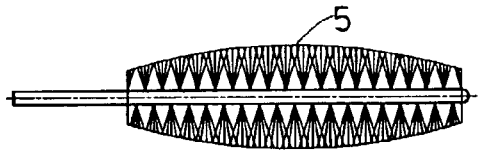
Figure 17:
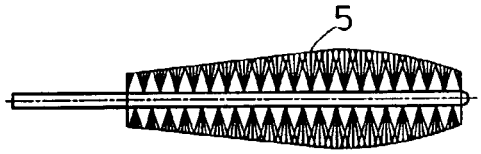
Figure 18:
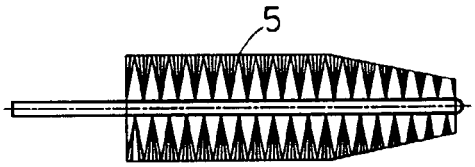
Figure 19:
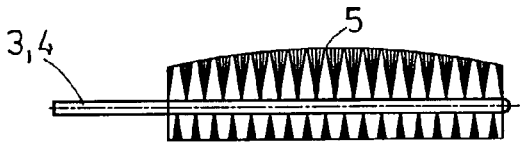
Figure 20:
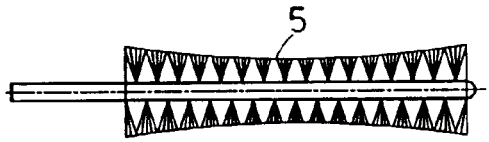
Figure 21:
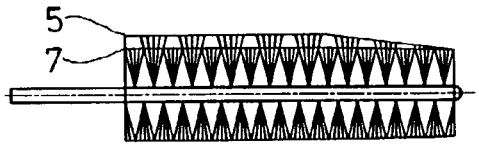
Figure 22:
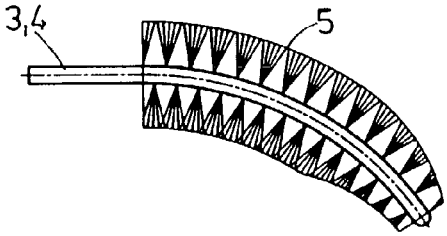

In FIGS. 14 through 22, possible shapes are presented for the outer envelope 7, namely in FIG. 14 overall conical; in FIG. 15 overall cylindrical; in FIG. 16 crowned-convex; in FIG. 17 a conical shape combined with a crowned-convex shape; in FIG. 18 a cylindrical shape combined with a conical end section; in FIG. 19 an asymmetric shape relative to the core formed by the twisted wires 3, 4, straight on the bottom and crowned, convex on the top; in FIG. 20 a concave shape; in FIG. 21 a cylindrical shape of the inner envelope 7 and, at a distance from the same, a cylindrical shape of the outer envelope 5, each with a conical end section; and FIG. 22 a curved shape of the twisted wires 3, 4 and a narrowing end section.

What is claimed is:

1. A mascara brush comprising a plurality of bristles (2) held between two twisted wire segments (3, 4), wherein the length of bristles (2) are essentially equal at the starting point of trimming and after trimming have varying lengths created by the trimming, wherein the brush (1) incorporates a first outer face of a predefined geometry created in a first trimming process of the plurality of bristles after twisting, wherein the first outer face is formed by the tips of first trimmed bristles (2), wherein a portion of the first trimmed bristles is trimmed by a second trimming process, so that at least a portion of second trimmed bristles (9) have a shorter length than the first trimmed bristles;

wherein the tips (8) of said portion of second trimmed bristles form a second outer face (7), the surface of which is parallel to the longitudinal axis of the twisted wire segments (3, 4) and is down in a perpendicular direction to the longitudinal axis of the twisted wire segments along the first trimmed bristles;

wherein the tips (8) of the second trimmed bristles (9) each lie in a cross-sectional view on an orthogonal straight line relative to said longitudinal axis of the twisted wire segments (3, 4) extending at a distance to the twisted wire segments; and wherein in the finalized brush the tips of the first trimmed bristles extend beyond the orthogonal straight trimming line (7) of the second trimmed bristles and the second trimmed bristles and the first trimmed bristles are intermingled in the region radially inside the orthogonal straight trimming line (7).

2. The mascara brush according to claim 1, wherein all the second trimmed bristles are shorter than the first trimmed bristles and form the second outer face, the surface of which is parallel to the axis of the twisted wire segments; and wherein the first outer face and the second outer face (7) respectively alternate in relatively short order from the first or second trimmed bristles to the second or first trimmed bristles.

3. The mascara brush according to claim 1, wherein all the second trimmed bristles are shorter than the first trimmed bristles and form the second outer face, the surface of which is parallel to the axis of the twisted wire segments; and wherein the second outer face (7) of the second trimmed bristles (9) extends along a central region of the brush (1).

4. The mascara brush according to claim 1, wherein all the second trimmed bristles are shorter than the first trimmed bristles and form the second outer face, the surface of which is parallel to the axis of the twisted wire segments; and wherein the second outer face (7) of the second trimmed bristles (9) extends along end regions of the brush.

5. The mascara brush according to claim 1, wherein all the second trimmed bristles are shorter than the first trimmed bristles and form the second outer face, the surface of which is parallel to the axis of the twisted wire segments; and wherein the second outer face (7) of the second trimmed bristles (9) extends only on one side of the brush (1) relative to the twisted wire segments (3, 4).

6. The mascara brush according to claim 1, wherein all the second trimmed bristles are shorter than the first trimmed bristles and form the second outer face, the surface of which is parallel to the axis of the twisted wire segments; and wherein the second outer face of the second trimmed bristles (9) is rectangular, triangular or rounded off in cross section.

7. The mascara brush according to claim 1, wherein the center longitudinal axis of the second outer face (7) coincides with the twisted wire segments (3, 4) or is offset from the twisted wire.

* * * * *